US005361057A

United States Patent [19]

Ito et al.

[11] Patent Number: 5,361,057

[45] Date of Patent: Nov. 1, 1994

[54] IGNITION COIL FOR INTERNAL COMBUSTION ENGINE

[75] Inventors: Takashi Ito, Katsuta; Hiroshi Watanabe, Takahagi, both of Japan

[73] Assignee: Hitachi, Ltd., Tokyo, Japan

[21] Appl. No.: 984,361

[22] Filed: Dec. 2, 1992

Related U.S. Application Data

[62] Division of Ser. No. 493,991, Mar. 15, 1990, abandoned.

[30] Foreign Application Priority Data

Mar. 15, 1989 [JP] Japan ..... 1-060994

[51] Int. Cl.[5] ..... H01F 27/30

[52] U.S. Cl. ..... 336/198; 336/206

[58] Field of Search ..... 336/96, 198, 208, 206, 336/100

[56] References Cited

U.S. PATENT DOCUMENTS

| | | | |
|---|---|---|---|
| 2,942,217 | 6/1960 | Ford | 336/206 |
| 3,018,455 | 1/1962 | Brandon, Jr. et al. | 336/206 |
| 3,533,037 | 10/1970 | Koch | 336/206 |
| 4,325,096 | 4/1982 | Sunohara et al. | 336/100 |
| 4,494,102 | 1/1985 | Fisher et al. | 336/198 |
| 4,912,447 | 3/1990 | Paul | 336/206 |

FOREIGN PATENT DOCUMENTS

| | | | |
|---|---|---|---|
| 2822093 | of 0000 | Germany . | |
| 3620826 | of 0000 | Germany . | |
| 523822 | 4/1931 | Germany | 336/200 |
| 5642316 | of 0000 | Japan . | |
| 55103712 | of 0000 | Japan . | |
| 2022006 | of 0000 | United Kingdom . | |
| 2064227 | of 0000 | United Kingdom . | |

*Primary Examiner*—Thomas J. Kozma
*Attorney, Agent, or Firm*—Ladas & Parry

[57] ABSTRACT

An ignition coil for an internal combustion engine has a corrodable metallic core (9, 10) about which is provided a circumferential primary coil former (1) upon which is wound a primary coil (2). Circumferentially disposed around the primary coil is a secondary coil (3) located on a former (13). So as to prevent the corrodable metallic core ( 9, 10 ) from fracturing the primary coil former, there is disposed an absorbing layer (12) between the core and the primary coil. The stress absorbing layer may be provided between the primary coil and the primary former or the primary former may comprise a deformable inner cylindrical member (1*b*) and a substantially rigid outer cylindrical member (1*a*) with the stress absorbing material (12) located in the annular space between the inner cylindrical member and the outer cylindrical member. The stress absorbing material in such an alternative embodiment may be formed of foamed rubber-like material or may be an air gap. In yet another embodiment the former about which the primary coil (2) is wound may be formed of a stress absorbing material.

5 Claims, 2 Drawing Sheets

IGNITION COIL FOR INTERNAL COMBUSTION ENGINE

This is a division of copending application Ser. No. 07/493,991 filed on Mar. 15, 1990, now abandoned.

BACKGROUND OF THE INVENTION

1. Field of the Invention

The present invention relates to an ignition coil for an internal combustion engine, and in particular, although not exclusively, relates to an ignition coil for an internal combustion engine having an iron core which is inserted through a primary former supporting a primary, coil.

2. Description of the Related Art

As disclosed in Japanese Patent Application Laid-Open No. 56-42316 (1981), a now often used ignition coil for an internal combustion engine is constructed by entirely enclosing a primary coil, a secondary coil, their associated bobbin former and an iron core within a synthetic resin.

In recent times it has become desirable to make the ignition coil of small size and light weight so that it is required to discard the enclosure entirely surrounding the iron core, coils and synthetic resin and instead to employ a structure in which the iron core is exposed. In particular, such a requirement is extremely desirable in an ignition device for a DIS (Direct Ignition System) which uses one ignition coil for one or two ignition plugs.

Such an ignition coil is disclosed in Japanese Patent Application Laid-Open No. 55-103712 (1980).

It is appreciated that the engine compartment where the ignition coil is mounted, is exposed to open air and directly receives the influence of the external atmosphere. Therefore, when a car runs on a road near the sea or one scattered with salt to melt snow in the winter, the engine compartment is filled with external air containing components of salt and water.

When such external air containing salt and water enters into the clearance between the primary former and the iron core inserted therethrough, the problem arises that the iron core rusts to produce a corrosion expansion so that stress due to the corrosion expansion is transmitted to the coil through the former and a crack occurs in a filler agent between the respective bobbins of the primary and secondary coils. The ignition coil then breaks down.

It is an object of this invention to provide an improved ignition coil. It is a further object of this invention to provide an ignition coil in which stress caused by corrosive expansion of the iron core is reduced.

SUMMARY OF THE INVENTION

According to this invention there is provided an ignition coil for an internal combustion engine including a corrodable metallic core and a circumferentially formed primary coil, characterised by a stress absorbing layer disposed between the core and the primary coil.

In a currently preferred embodiment the primary coil is formed on a primary former and the stress absorbing layer is provided between the primary coil and the primary former.

In an alternative embodiment there is provided a primary former comprising a deformable inner cylindrical member and a substantially rigid outer cylindrical member, and said stress absorbing material is located in the annular space between the inner cylindrical member and the outer cylindrical member.

In such an alternative embodiment the stress absorbing layer is a foamed rubber-like material or an air gap.

In another embodiment the primary coil is wound on a primary former made of stress absorbing material.

Thus in the present invention, a stress absorbing layer, which is capable of absorbing stress due to corrosion expansion of a metallic core, such as an iron core, is formed between the core and a primary coil.

BRIEF DESCRIPTION OF THE DRAWINGS

The invention will now be described by way of example with reference to the accompanying drawings in which.

In the Figures like reference numerals denote like parts.

DESCRIPTION OF THE PREFERRED EMBODIMENTS

Figure 1:
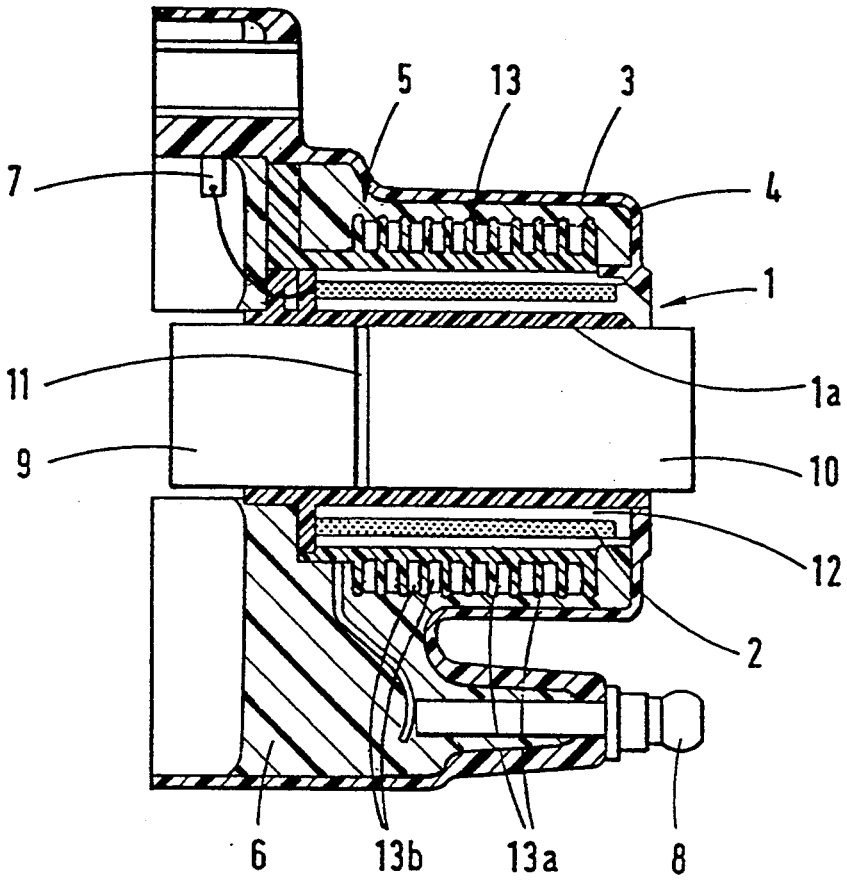
FIG. 1 is a cross-sectional view of one embodiment of an ignition coil for an internal combustion engine in accordance with this invention.

The ignition coil shown in FIG. 1 has a coil former (bobbin) 1 made of polybutylene terephthalate, a primary coil 2, a secondary coil 3, a coil case 4, a coil portion 5, an insulation cast resin 6 containing glass filler material, two primary terminals 7 (only being shown in FIG. 1), a high voltage terminal 8, iron cores 9, 10 which are each laminated, an air gap 11 and a stress absorbing layer 12.

The coil bobbin 1 is for supporting the primary coil 2 and the secondary coil 3 and includes a cylindrical shaped primary coil bobbin portion 1*a* with the secondary coil having a concentrically formed cylindrical bobbin portion 13 formed radially outside the portion 1*a*.

Thereby, a cylindrical shaped clearance is formed between the primary coil bobbin portion la and the secondary coil bobbin portion 13 with the primary coil 2 located in the clearance.

Further, on the circumferential surface of the secondary coil bobbin portion 13, numerous collars 13*a* are formed in parallel with a predetermined spacing therebetween, thereby constituting numerous groove portions 13*b*, in each of which is wound the secondary coil. The primary coil bobbin 1 and the secondary coil bobbin 13 are formed by, for example, an injection molding technique using thermoplastic synthetic resin.

A self fusing enamel wire having a diameter about 0.3–1.0 mm is used for the primary coil 2. After winding the wire into one or multilayers with a winding jig, the wire is heated at 100–200° C. for integrally fusing the windings together and thereafter inserted into the forementioned clearance of the coil bobbin 1. If a wire having a comparatively large diameter such as 1.0 mm is used for the primary coil 2 then it normally holds together after forming on the winding jig and there is no need to heat the winding to effect self fusing, so that after carrying out the winding operation, the winding is directly attached into the coil bobbin. Alternatively, the primary coil may be integrally formed using an adhesive agent such as a thermosetting synthetic resin instead of the above mentioned self fusing enamel wire.

An enamel wire having a diameter of about 0.03–0.1 mm is used for the secondary coil 3. The secondary coil has about 5000–20000 turns in total which are each wound into a plurality of discrete groove portions 13*b*.

The coil bobbin 1, completed by winding the secondary coil 3 into the groove portions 13*b* and inserting the primary coil 2 into the clearance between the bobbin 1 and the secondary coil bobbin portion 13, is covered by the coil case. At this time a projection at the right hand end (as shown in FIG. 1) of the coil bobbin 1 is engaged in a hole at the end of the coil case 4.

The insulation resin 6 formed of thermosetting synthetic resin such as epoxy resin is poured into the coil case 4 and is thermoset after sufficient impregnation thereof into the respective coils.

At this time, the winding start portion and end portion of the primary coil 2 are respectively connected to the two primary terminals 7 provided in the coil case 4 (only one being shown in FIG. 1 for clarity). The winding start portion of the secondary coil 3 is connected to either of the two primary terminals 7, and the winding end portion of the secondary coil is connected to the high voltage terminal 8.

After these operations, the laminated iron cores 9 and 10 are assembled in the coil bobbin 1, and an air gap 11 is formed at the junction portion of the iron cores, thereby the maximum magnetic flux density passing through the iron cores 9 and 10 is limited.

As thus far described, the iron cores 9 and 10 are exposed to open air as explained above and the thus formed coil would now be mounted in an engine compartment if conventional practice were followed.

Thus, as explained above, when external air containing salt and water fills between the iron cores 9 and 10 and the primary coil bobbin portion 1*a* of the coil bobbin 1 through capillary phenomenon, etc., rust is produced at this portion. In particular, rust is very prevalent near the air gap 11 of the iron cores 9 and 10.

When the rust produced on the iron cores 9 and 10 expands, a stress is caused by the expansion which acts from the iron cores 9 and 10 toward the primary coil bobbin portion 1*a*. Accordingly, in the conventional ignition coil there is the problem that this stress acts on the primary coil 2 to cause a crack on the filler agent in the cast resin 6. An additional problem occurs in the prior art device in that when the filler fills the clearance between the primary coil bobbin portion 1*a* and the secondary coil bobbin portion 13, the stress further reaches to the secondary coil 3.

To overcome this problem, the present invention provides a stress absorbing layer 12 between the primary coil bobbin la and the primary coil 2, so that the stress due to rusting (oxidisation) of the iron core is absorbed through the stress absorbing layer 12 so that the stress acting on the primary coil 2 and/or the secondary coil 3 is reduced and the problem of the crack generation is eliminated.

Figure 2:
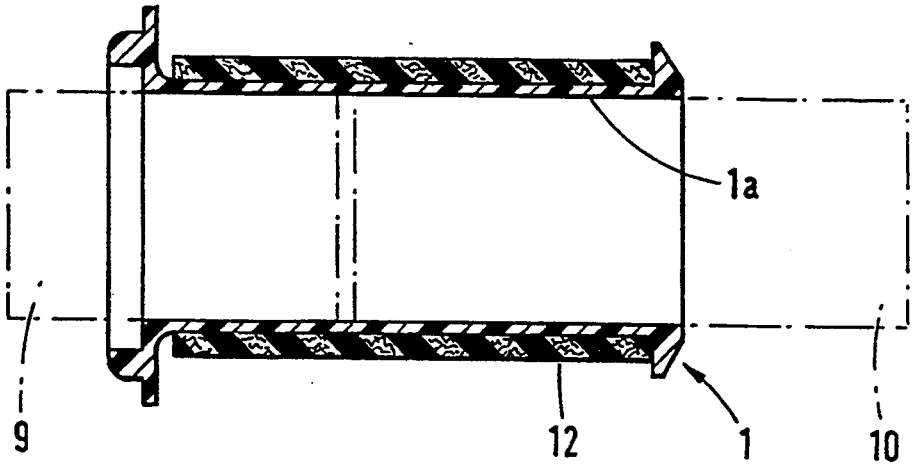
FIG. 2 is an enlarged cross-sectional view of a primary coil former (bobbin)

FIG. 2 is an enlarged cross-sectional view illustrating the stress absorbing layer 12 provided on the primary coil bobbin portion 1*a*, wherein the stress absorbing layer 12 is provided on the outer circumference of the primary coil bobbin portion 1*a*; the primary coil 2 (not shown in FIG. 2) is disposed on the circumference of the stress absorbing layer 12.

The material for the stress absorbing layer 12 is formed from a foamed rubber-like sheet in which is located a plurality of air bubbles and such a material may be that sold by Mitsubishi Petrochemical Co. Ltd. under the trademark THERMORUN. With the rubber-like sheet being foamed, a mechanism of absorbing the stress by crushing the layer is utilised.

Figure 3:
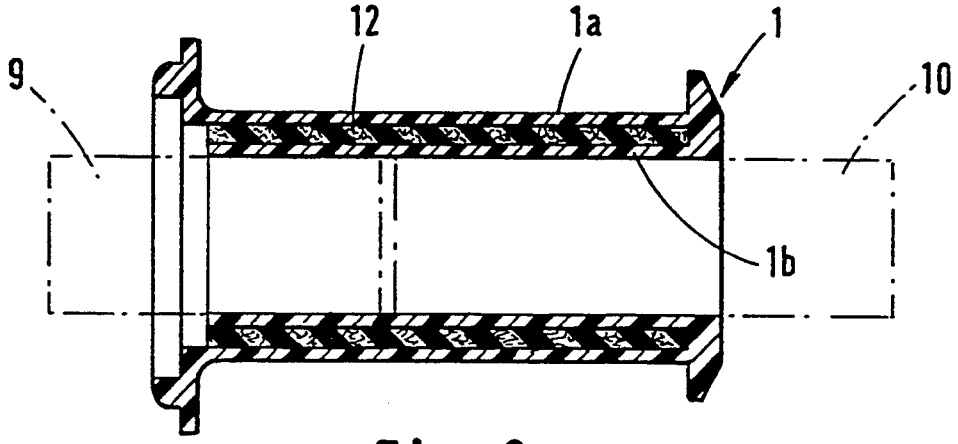
FIG. 3 to FIG. 5 inclusive each show an enlarged cross-sectional view of alternative embodiments of the primary coil former (bobbin).

FIG. 3 shows an alternative embodiment of the present invention wherein the stress absorbing layer 12 formed of the rubber-like sheet including independent air bubbles is disposed on the inner circumference of the primary coil bobbin portion 1*a*.

Accordingly in the FIG. 3 embodiment, the stress due to the corrosion expansion of the iron cores 9 and 10 is absorbed through the rubber-like sheet including independent air bubbles therein so that the generation of cracks is eliminated, wherein the stress absorbing layer 12 is surrounded by an annular shaped reinforcing portion lb and one end of this annular shaped reinforcing portion lb is free to move to facilitate deformation thereof.

Figure 4:
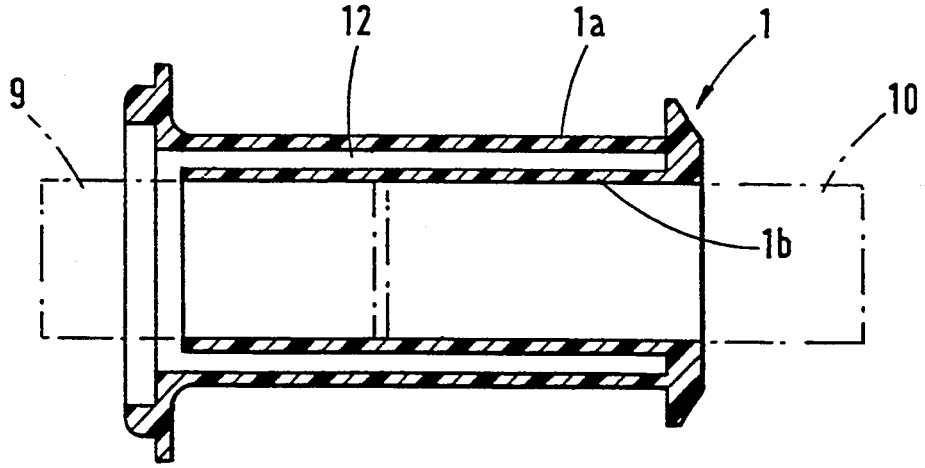

FIG. 4 shows a further alternative embodiment of the present invention, wherein an air layer is employed for the stress absorbing layer 12 instead of the stress absorbing layer of the rubber-like sheet including independent air bubbles therein shown in FIG. 3. In this embodiment the annular shaped reinforcing portion 1*b* is of course required and the stress is absorbed through deformation of this annular shaped reinforcing portion 1*b*. Further in this embodiment, provision of a plurality of slits along the axial direction of the annular shaped reinforcing portion lb may be needed depending on specific requirements.

Figure 5:
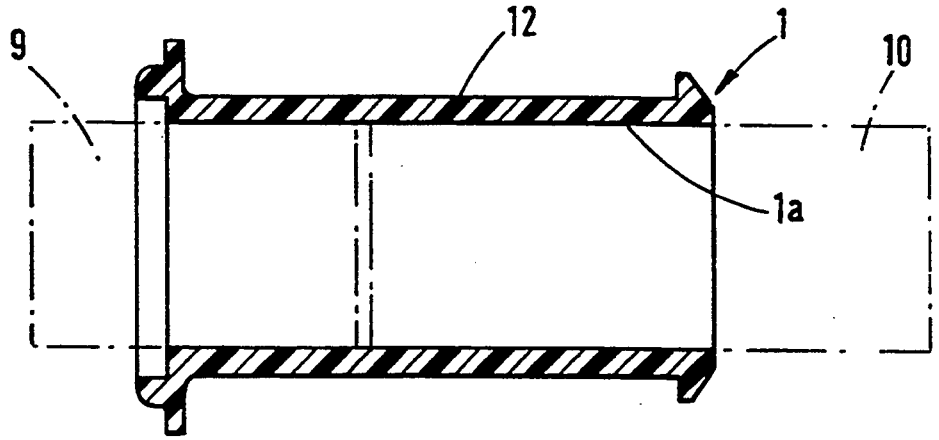

FIG. 5 shows a still further alternative embodiment of the present invention, wherein the stress absorbing layer 12 is constituted by the primary coil bobbin 1*a* itself by providing a deformable property thereto. In this embodiment, opposing ends of the primary coil bobbin are formed of a synthetic resin having a high stiffness and therebetween is formed of a deformable synthetic resin including synthetic unwoven cloth or the like such as polyethylene terephthalate. Thereby the stress due to the corrosion expansion is absorbed.

Having described the exemplary embodiments of the present invention, it will be understood that the stress absorbing layer is formed between the iron core and the primary coil so that the stress due to the corrosion expansion of the iron core is absorbed and problems such as cracking in the normally provided filling agent is eliminated.

Also, having thus described the invention with reference to specific embodiments, it is to be understood that changes may be made without departing from the spirit and scope of the present invention as defined by the appended claims.

We claim:

1. An ignition coil for an internal combustion engine comprising:

a core, which is partially exposed to open air and made of corrodable metallic material;

a primary coil, circumferentially formed around said core;

a primary former on which said primary coil is wound, said primary former comprising a deformable inner cylindrical member and a substantially rigid outer cylindrical member whereby an annular space is formed between the inner cylindrical member and the outer cylindrical member;

a secondary coil circumferentially formed around said primary coil so as to be magnetically associated with said primary coil; and stress absorbing means, disposed between said core and said primary coil for preventing stress due to corrosive expansion of said core being exerted on said primary coil.

2. An ignition coil as claimed in claim 1 wherein said stress absorbing means is located in said annular space.

3. An ignition coil as claimed in claim 2 wherein said stress absorbing means is a foamed rubber-like material.

4. An ignition coil as claimed in claim 3 wherein said foamed rubber-like material is of the type that independent air bubbles are included therein.

5. An ignition coil as claimed in claim 1 wherein said stress absorbing means is an air gap in said annular space.

* * * * *